US008022887B1

(12) United States Patent
Zarnaghi

(10) Patent No.: US 8,022,887 B1
(45) Date of Patent: Sep. 20, 2011

(54) PLANAR ANTENNA

(75) Inventor: Rokhsareh Zarnaghi, Santa Clara, CA (US)

(73) Assignee: Sibeam, Inc., Sunnyvale, CA (US)

( * ) Notice: Subject to any disclaimer, the term of this patent is extended or adjusted under 35 U.S.C. 154(b) by 0 days.

(21) Appl. No.: 11/588,472

(22) Filed: Oct. 26, 2006

(51) Int. Cl.
*H01Q 1/48* (2006.01)
*H01Q 1/38* (2006.01)

(52) U.S. Cl. ..... 343/846; 343/700 MS; 343/833; 343/803

(58) Field of Classification Search ..... 343/803, 343/833, 859, 700 MS, 846–849, 810–821
See application file for complete search history.

(56) References Cited

U.S. PATENT DOCUMENTS

| | | | | |
|---|---|---|---|---|
| 7,289,068 | B2 * | 10/2007 | Fujio et al. | 343/700 MS |
| 7,307,588 | B2 * | 12/2007 | Tseng | 343/700 MS |
| 7,342,299 | B2 * | 3/2008 | Gaucher et al. | 257/674 |
| 2004/0017315 | A1 * | 1/2004 | Fang et al. | 343/700 MS |
| 2004/0196202 | A1 | 10/2004 | Shirosaka et al. | |
| 2005/0237260 | A1 * | 10/2005 | Bancroft | 343/859 |
| 2006/0001572 | A1 | 1/2006 | Gaucher et al. | |
| 2007/0013599 | A1 * | 1/2007 | Gaucher et al. | 343/795 |

FOREIGN PATENT DOCUMENTS

EP 1 263 085 A1 12/2002

OTHER PUBLICATIONS

William R. Deal, A New Quasi-Yagi Antenna for Planar Active Antenna Arrays, IEEE Transactions on Microwave Theory & Techniques, vol. 48, Issue No. 6, Jun. 2000, pp. 910-918.*

Collin, Robert E., "Foundations for Microwave Engineering", New York: McGraw-Hill, Inc., 1992, pp. 130, 175.

Song, Hyok J., et al., Investigations Into the Operation of a Microstrip-fed Uniplanar Quasi-Yagi Antenna, Antennas and Propagation Society International Symposium, Jul. 16, 2000, pp. 1436-1439, vol. 3, IEEE, Piscataway, New Jersey. USA.

Grajek, Phillip R., et al., A 24-Ghz High-Gain Yagi-Uda Antenna Array, IEEE Transactions on Antennas and Propagation, May 1, 2004, pp. 1257-1261, vol. 52, No. 5, IEEE Service Center, Piscataway, New Jersey, USA.

Ha, Cheunsoo, et al., A Modified Quasi-Yagi Planar Antenna With Wideband Characteristics in C-Band, IEEE Antennas and Propagation Society International Symposium, Jul. 8, 2001, pp. 154-157, vol. 3, IEEE, New York, New York, USA.

European Search Report for European Patent Application No. 08167066.3, Apr. 15, 2009, 8 pages.

Colin, Robert E., "Foundations for Microwave Engineering", Second Edition; McGraw-Hill, Inc. 1992, p. 2.

Lampe, Ross W., "Design Formulas for an Asymmetric Coplanar Strip Folded Dipole", IEEE Transactions on Antennas and Propagation, vol. AP-33, No. 9, Sep. 1985, pp. 1028-1031.

Nikolic, Nasiha, et al., "Printed Quasi-Vagi Antenna with Folded Dipole Driver", Antennas and Propagation Society International Symposium, 2009. APSURSI, IEEE Publication Year: 2009, pp. 1-4.

Qin, Pei Y., "A Reconfigurable Quasi-Vagi Folded Dipole Antenna", National Key Laboratory of Antenna and Microwave Technology; Antennas and Propagation Society International Symposium, 2009, APSURSI, Publication Year: 2009, pp. 1-4.

Kaneda, Noriaki et al., "A Broad-Band Planar-Quasi-Yagi Antenna", IEEE Transactions on Antennas and Propagation, vol. 50, No. 8, Aug. 2002. pp. 1158-1160 (3 pages).

* cited by examiner

*Primary Examiner* — Jacob Y Choi
*Assistant Examiner* — Robert Karacsony
(74) *Attorney, Agent, or Firm* — Blakely, Sokoloff, Taylor & Zafman LLP

(57) ABSTRACT

An antenna is disclosed. In one embodiment, the antenna comprises a driver comprising a folded dipole and an integral balun coupled to the folded dipole.

18 Claims, 10 Drawing Sheets

PLANAR ANTENNA

FIELD OF THE INVENTION

The present invention relates to a device for receiving/transmitting electromagnetic waves with high efficiency and low VSWR over a broad bandwidth that can be used most particularly in the field of wireless transmissions.

BACKGROUND

Ever increasing use of mm-wave frequencies in communication systems, particularly those with high data rate, requires efficient antennas. Antenna directivity and radiation efficiency has to be reasonably high to overcome the high free space losses at mm-wave frequencies.

Highly efficient planar radiating elements can have various applications. They can be used as the radiating elements on an array, particularly of electronically steered type. In cases where high gain radiators are required, they can be used as the feeding element of a non-array antenna such as a horn or reflector antenna to avoid considerable feed losses, e.g. such as in mm-wave. Millimeter- and submillimeter-wave devices often utilize integrated circuits combined with waveguide components. This requires transitions between waveguides and different planar transmission lines. In addition, transitions to waveguide measurement systems are often needed for device characterization and testing. Efficient planar radiating elements can be tuned for such applications.

U.S. Pat. No. 4,825,220 (Edward et al.) discloses a planar antenna that provides wide bandwidth. FIG. 1 illustrates the planar antenna. Referring to FIG. 1, the structure utilizes a two-layer configuration that is a drawback in terms of manufacturing. Furthermore, the VSWR is not very low and the gain is not high.

Another prior art antenna, depicted in FIGS. 2A and 2B, is the uniplanar Yagi-like type, which consists of two dipole elements, a truncated ground plane and a microstrip-to-coplanar strips (hereinafter the term "coplanar strips" is abbreviated "CPS") balun. The two dipole elements include a director and a driver. The director and driver of the antenna are placed on the same plane of the substrate so that the surface waves generated by the antenna are directed to the end-fire direction.

SUMMARY OF THE INVENTION

An antenna is disclosed. In one embodiment, the antenna comprises a driver comprising a folded dipole and an integral balun coupled to the folded dipole.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

FIG. 3B illustrates a microstrip line feeding structure while FIG. 3C illustrates a coplanar waveguide feeding structure according to one embodiment of the invention. FIG. 3D illustrates a truncated ground which is serrated;

DETAILED DESCRIPTION

An improved compact planar radiating radio-frequency (RF) element is described. Embodiments of the planar element have broadband high performance and are useful for microwave and millimeter-wave frequencies. In one embodiment, the radiating element comprises a folded-dipole as the main driver, one or more directors, and a balanced feeding structure that is amenable to miniaturization and has a low VSWR. In one embodiment, the folded dipole is a directly fed element, i.e. driver, in a Yagi-like planar antenna.

Accordingly, embodiments of the present invention provide an improved radiating element for use as the feeding element of another antenna. The radiating element may be used in an array and may be may be fabricated using printed circuit techniques.

In the following description, numerous details are set forth to provide a more thorough explanation of the present invention. It will be apparent, however, to one skilled in the art, that the present invention may be practiced without these specific details. In other instances, well-known structures and devices are shown in block diagram form, rather than in detail, in order to avoid obscuring the present invention.

Overview

Figure 1:
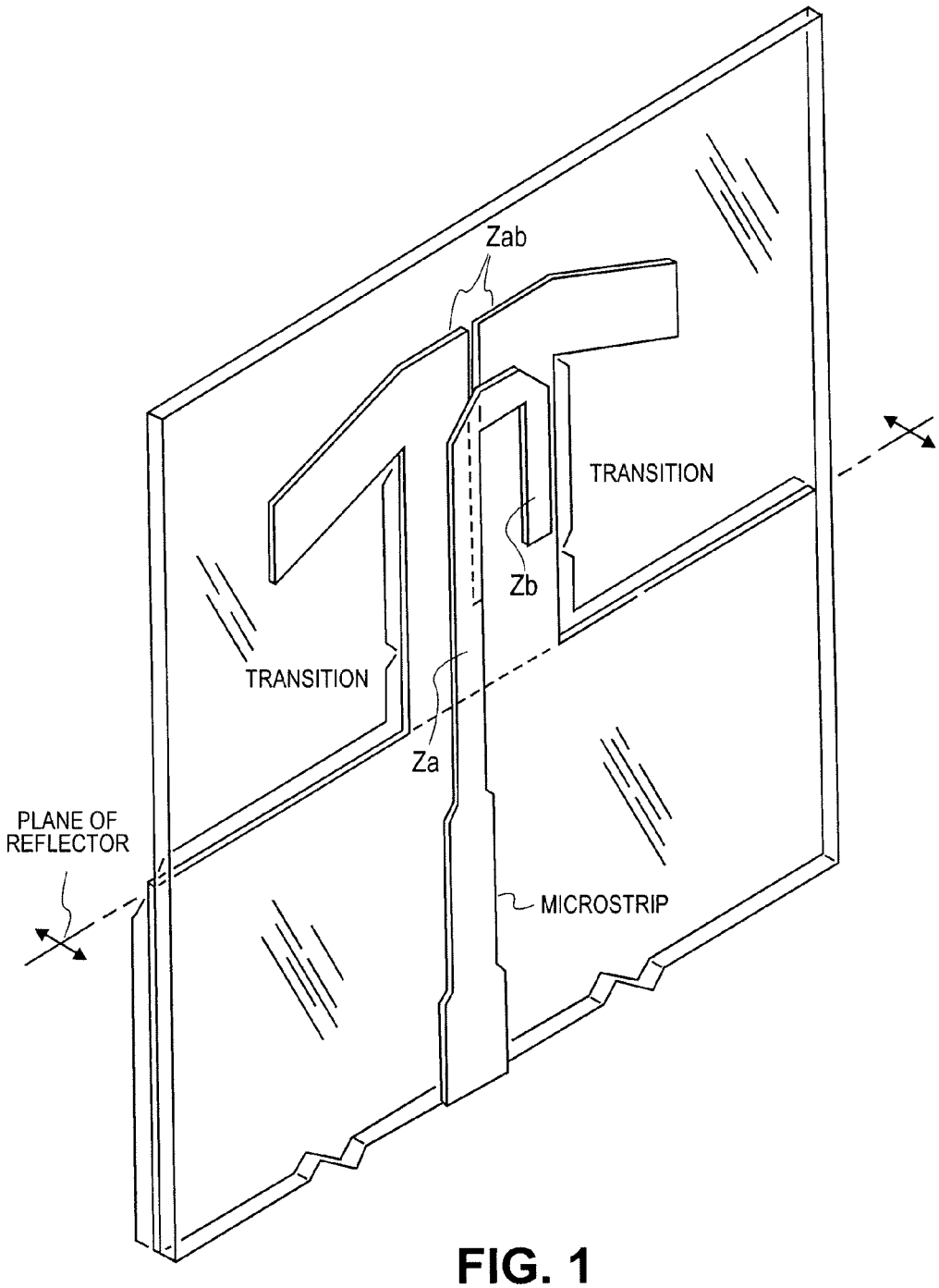
FIG. 1 (PRIOR ART)
FIG. 1 illustrates a planar antenna of the prior art.
Figure 2A:
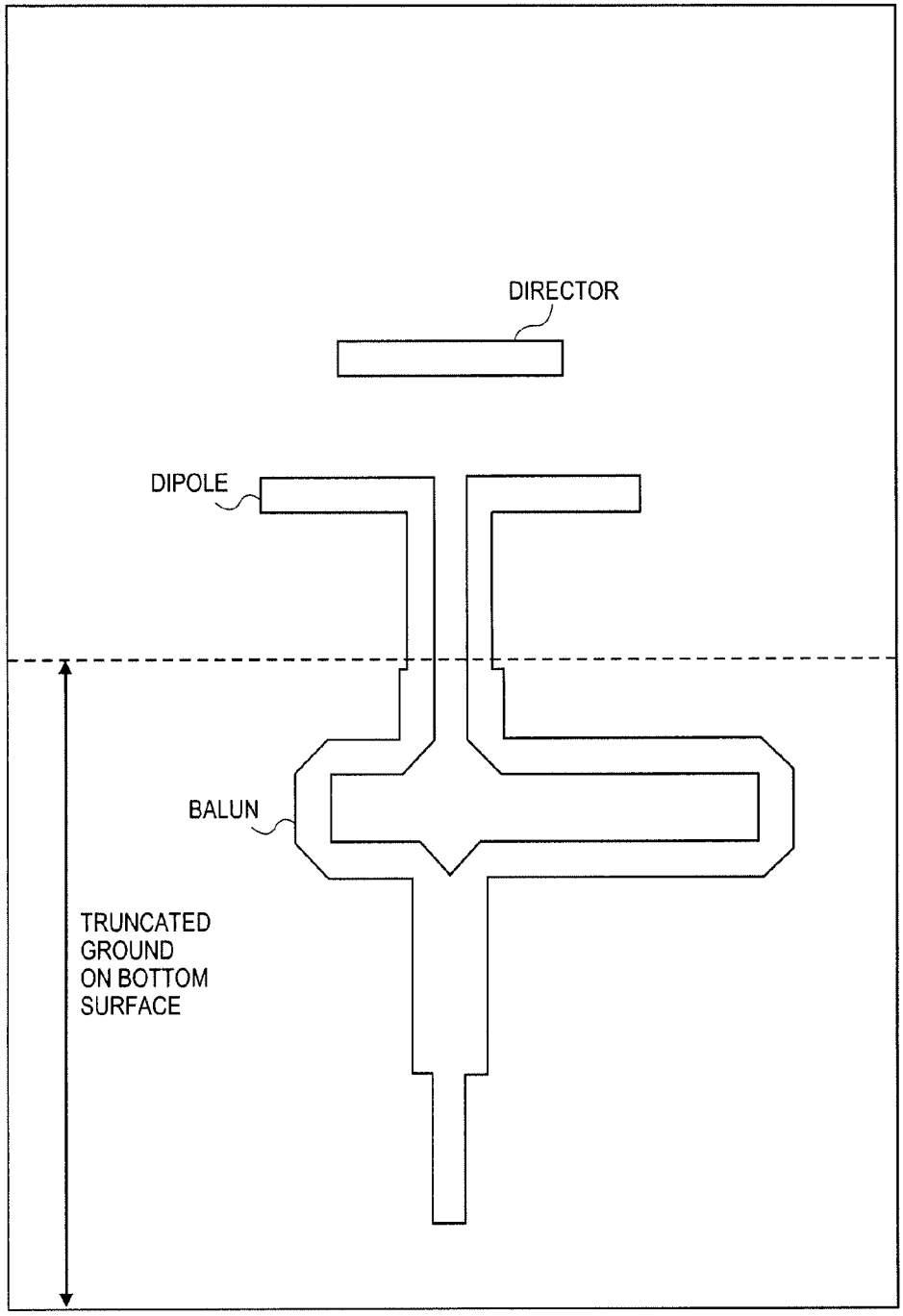
FIG. 2A (PRIOR ART)
FIGS. 2A and 2B depict top and isometric views of another prior art planar antenna, respectively.
Figure 2B:
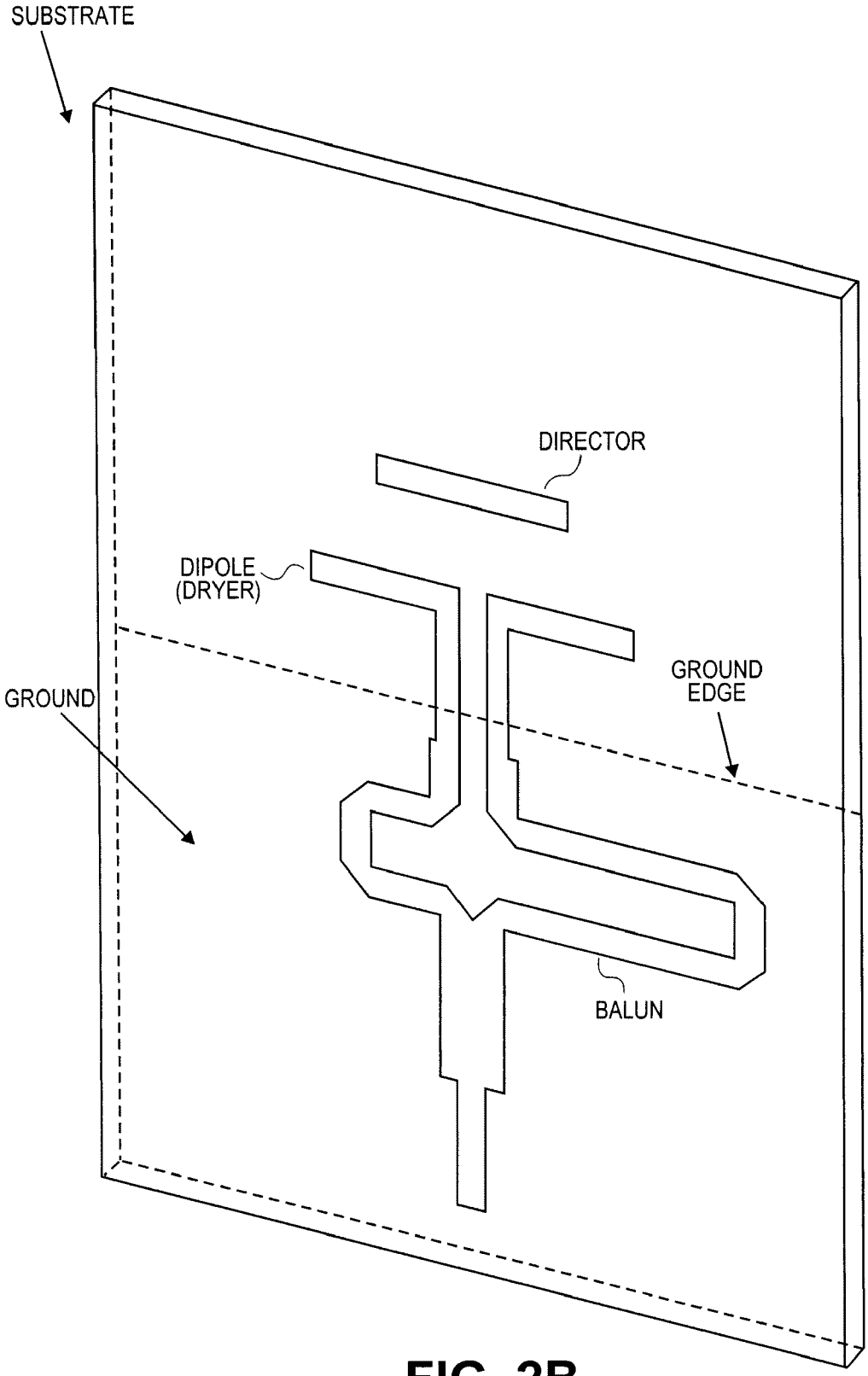
FIG. 2B (PRIOR ART)
Figure 3A:
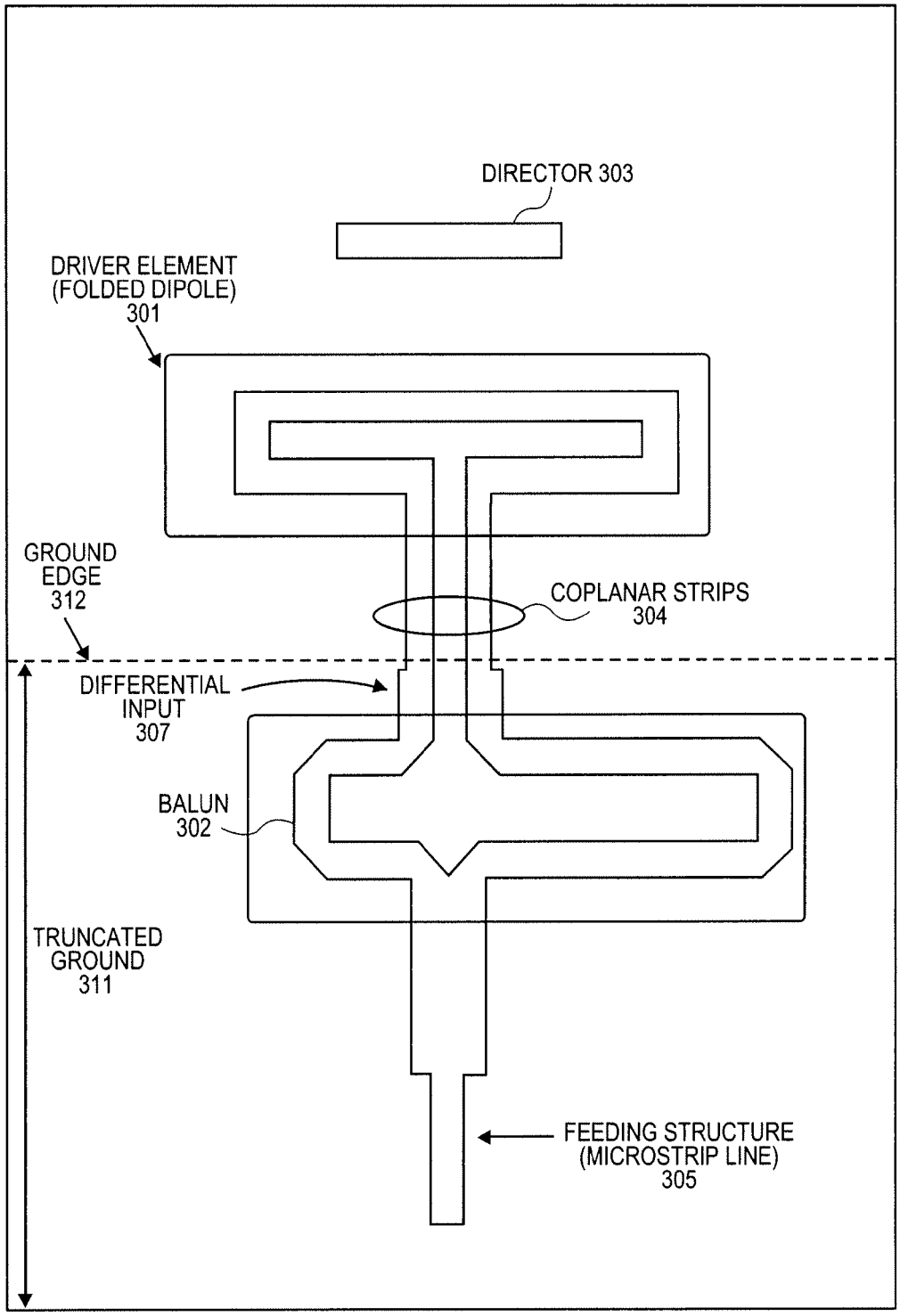
FIGS. 3A, 3B, 3C, and 3D illustrate top and isometric views of an improved planar antenna according to one embodiment of the present invention, respectively.
Figure 3B:
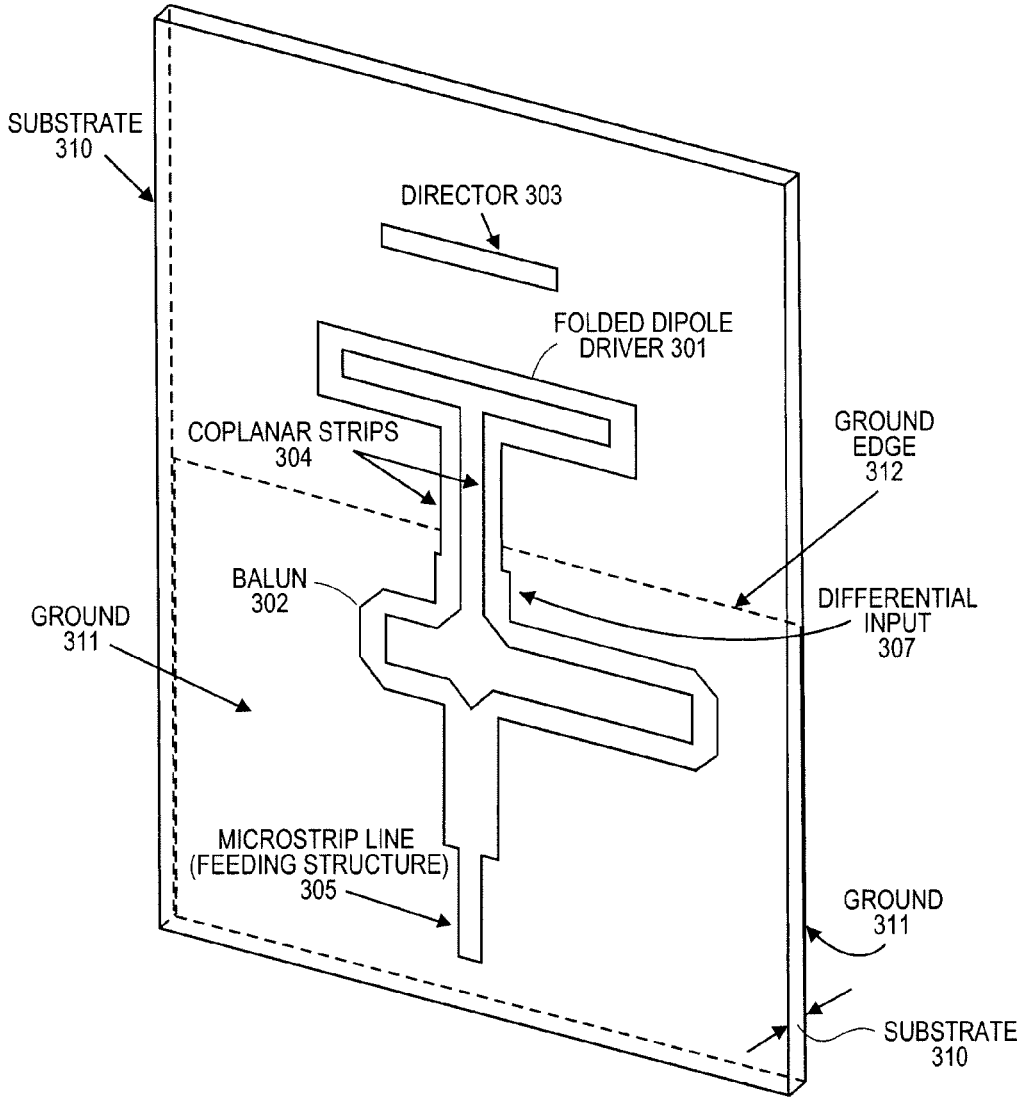

Embodiments of the present invention provide an efficient yet easy-to-implement approach to provide one or more of the above mentioned goals. FIGS. 3A and 3B illustrate top and isometric views an improved planar antenna according to one embodiment of the present invention, respectively. Referring to FIG. 3A, a folded dipole 301 operates as the driver, or main radiating portion, of a Yagi-like planar antenna. Thus, all the benefits of the prior art antenna, albeit with improved VSWR and improved impedance matching will be achieved.

More specifically, folded dipole 301 is coupled to balun 302 via coplanar strips 304. Thus, the structure is a quasi-Yagi with its balun in combination with a folded dipole. In operation, electromagnetic energy is coupled from folded dipole 301 through space into the parasitic dipoles and then reradiated to form a directional beam.

In one embodiment, folded dipole 301 and balun 302 are on a substrate, such as substrate 310 in FIG. 3B. In another embodiment, balun 302 is not on the substrate.

The antenna includes a director 303. Although only one director is shown, the antenna may have more than one director (e.g., two directors, three directors, etc.). If more than one director is used, they are typically parallel and on the same side of the driver.

The antenna also includes feeding structure 305. In one embodiment, feeding structure 305 is a balanced feeding structure that comprises a feeding transmission line. The feeding transmission line may comprise, but is not limited to, a coplanar waveguide 306 in FIG. 3C (hereinafter referred to as "CPW") or a microstrip line. Feeding structure 305 in combination with balun 302 provide a differential input to folded dipole 301 using coplanar strips 304.

Referring to FIG. 3B, driver 301, balun 302, director 303 and feeding structure 305 (microstrip line) are located on one side of substrate 310, while ground plane 311 is located on the other side of substrate 310. In one embodiment, ground plane 311 is a located only beneath balun 302 and feeding structure 305, and not beneath driver 301 and director 303. Thus, ground plane 311 is a truncated ground plane. In one embodiment, ground plane 311 is a microstrip ground plane. In such a case, the truncated microstrip ground plane 311 is used as the reflecting element, thereby eliminating the need for a reflector dipole.

Ground plane 311 has a ground edge 312 at the bottom of the substrate that operates as the reflector to reflect the electromagnetic wave. In one embodiment, ground edge 312 is a straight edge; however, this is not required and in other embodiments, ground edge 312 may not be straight. For example, in another embodiment, ground edge 312 may be serrated.

In one embodiment, substrate 310 comprises a planar material with a high dielectric constant. For example, a planar material with a dielectric constant of 10 or more may be used, such as alumina. Because of its planar nature, the antenna is not difficult to manufacture and may be manufactured using printed circuit board (PCB) fabrication techniques.

Figure 3C:
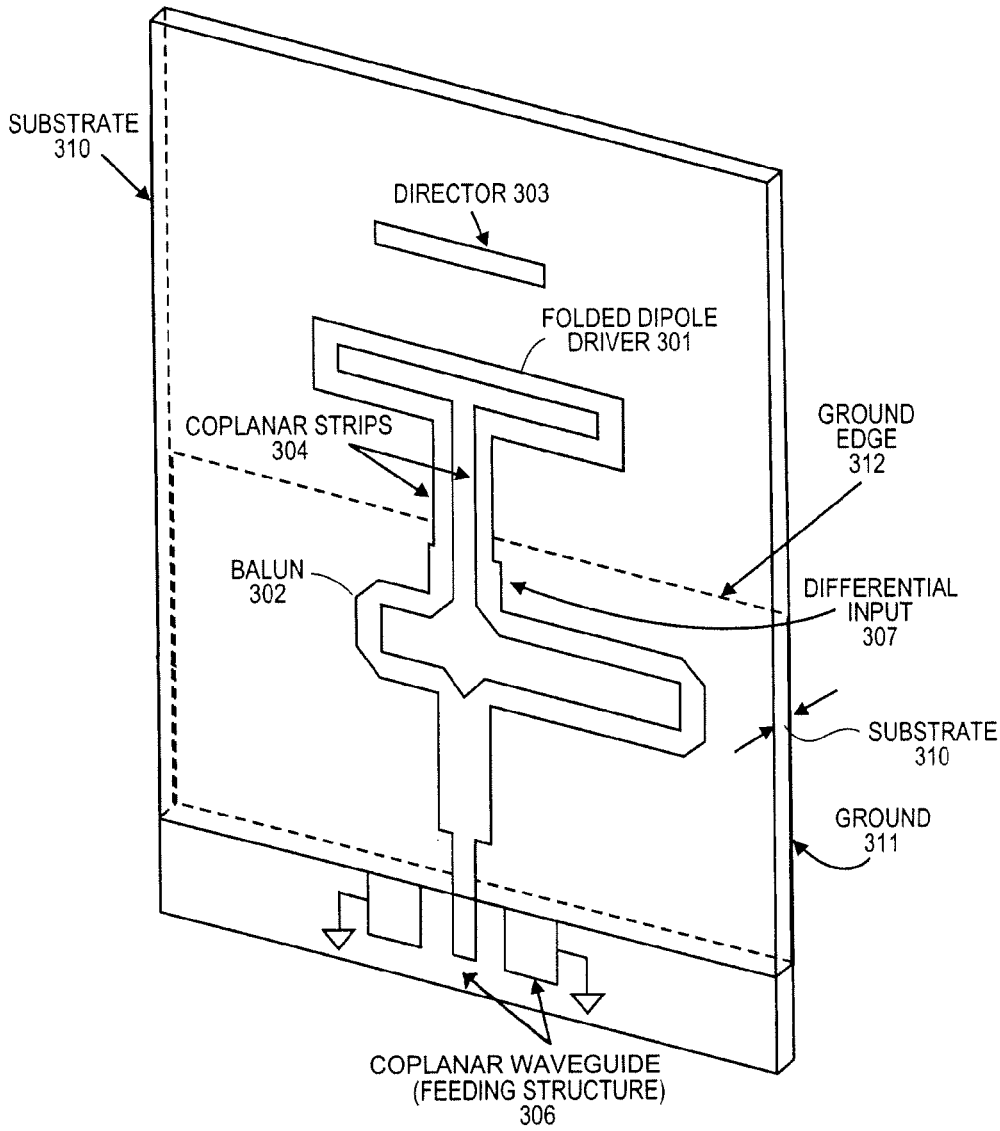
Figure 3D:
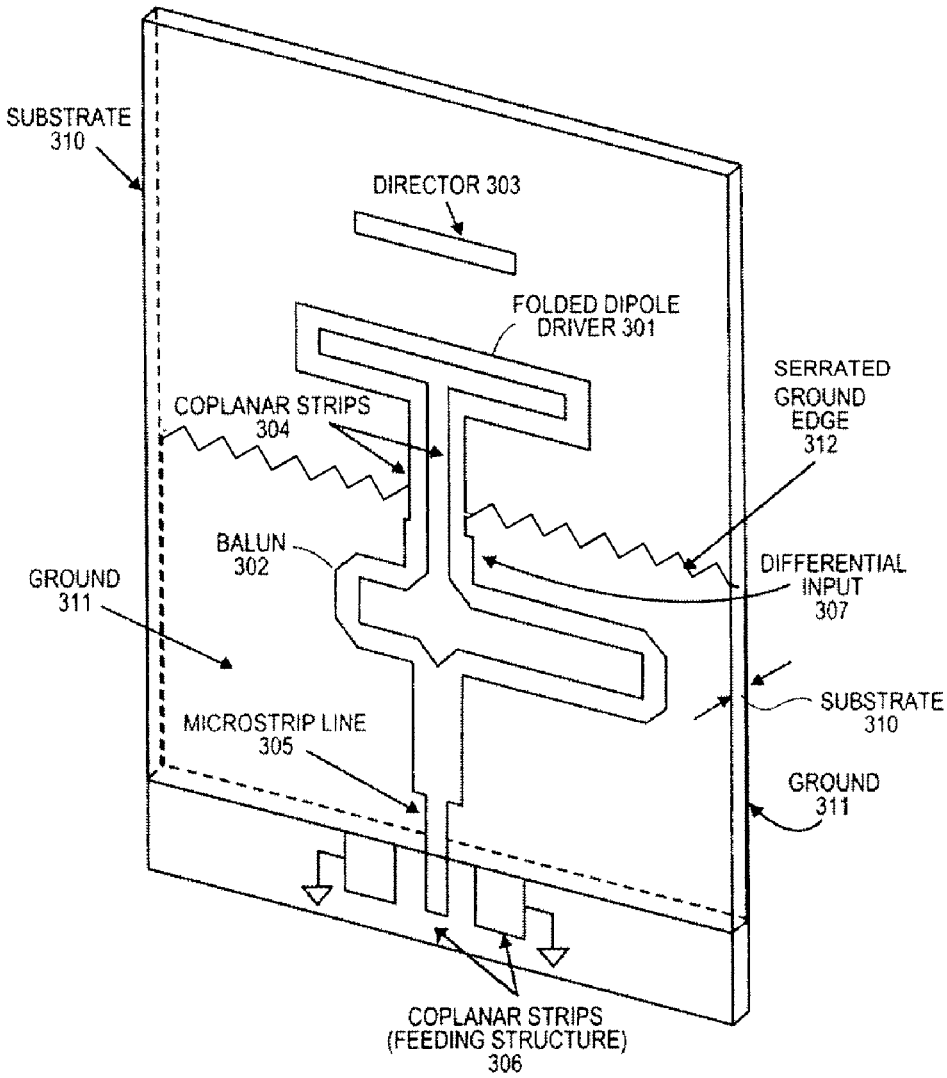

Thus, the antenna described in conjunction with FIGS. 3A, 3B, and 3C is compact with a very wide bandwidth with low VSWR.

The antenna described herein has been used for a variety of applications, including those that require very broad bandwidth or high gain. In one embodiment, the antenna is used for linear phased arrays, such as, but not limited to, millimeter wave applications and in applications where substrates with high dielectric constants are used. If used in the linear phased array, the antenna may provide at least 15 percent of bandwidth for a VSWR much better than 2, i.e., a return-loss better than −10 dB, efficiency close to 90 percent and a very broad beam.

There are a number of advantages of using embodiments of the antenna described herein. For example, one advantage of one embodiment of the antenna is that it has a lower VSWR over at least the same or wider bandwidth than prior art antennas described above. In another embodiment of the antenna, the radiating element is smaller, which results in less coupling between radiating elements for the same inter-element distance.

An Example of a Communication System

Figure 4:
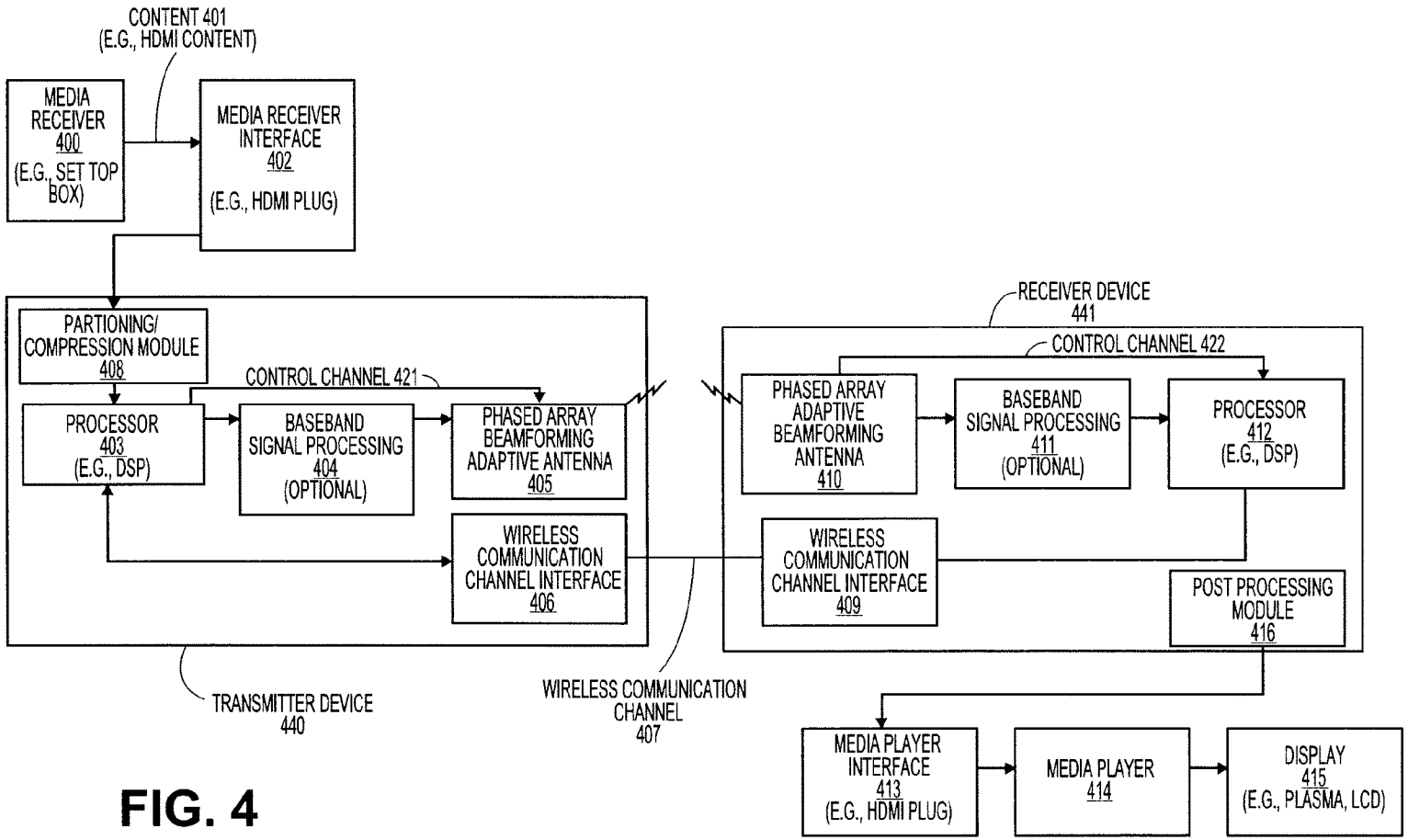
FIG. 4 is a block diagram of one embodiment of a communication system.

FIG. 4 is a block diagram of one embodiment of a communication system that includes the antenna disclosed above. Referring to FIG. 4, the system comprises media receiver 400, a media receiver interface 402, a transmitting device 440, a receiving device 441, a media player interface 413, a media player 414 and a display 415.

Media receiver 400 receives content from a source (not shown). In one embodiment, media receiver 400 comprises a set top box. The content may comprise baseband digital video, such as, for example, but not limited to, content adhering to the HDMI or DVI standards. In such a case, media receiver 400 may include a transmitter (e.g., an HDMI transmitter) to forward the received content.

Media receiver 401 sends content 401 to transmitter device 440 via media receiver interface 402. In one embodiment, media receiver interface 402 includes logic that converts content 401 into HDMI content. In such a case, media receiver interface 402 may comprise an HDMI plug and content 401 is sent via a wired connection; however, the transfer could occur through a wireless connection. In another embodiment, content 401 comprises DVI content.

In one embodiment, the transfer of content 401 between media receiver interface 402 and transmitter device 440 occurs over a wired connection; however, the transfer could occur through a wireless connection.

Transmitter device 440 wirelessly transfers information to receiver device 441 using two wireless connections. One of the wireless connections is through a phased array antenna with adaptive beamforming. The other wireless connection is via wireless communications channel 407, referred to herein as the back channel. In one embodiment, wireless communications channel 407 is uni-directional. In an alternative embodiment, wireless communications channel 407 is bi-directional.

Receiver device 441 transfers the content received from transmitter device 440 to media player 414 via media player interface 413. In one embodiment, the transfer of the content between receiver device 441 and media player interface 413 occurs through a wired connection; however, the transfer could occur through a wireless connection. In one embodiment, media player interface 413 comprises an HDMI plug. Similarly, the transfer of the content between media player interface 413 and media player 414 occurs through a wired connection; however, the transfer could occur through a wireless connection.

Media player 414 causes the content to be played on display 415. In one embodiment, the content is HDMI content and media player 414 transfer the media content to display via a wired connection; however, the transfer could occur through a wireless connection. Display 415 may comprise a plasma display, an LCD, a CRT, etc.

Note that the system in FIG. 4 may be altered to include a DVD player/recorder in place of a DVD player/recorder to receive, and play and/or record the content.

Figure 6:
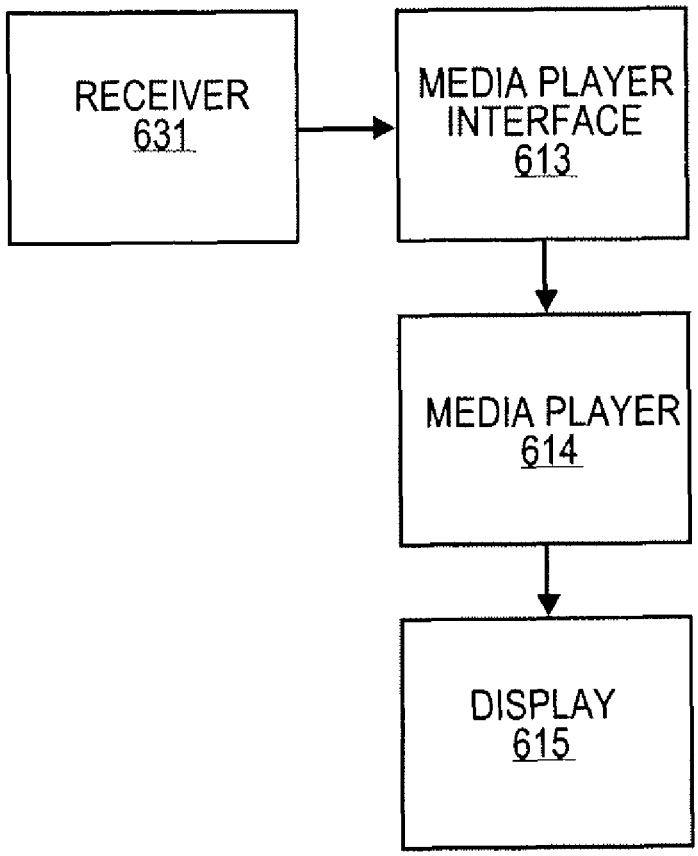
FIG. 6 is a block diagram of one embodiment of a peripheral device.

In one embodiment, transmitter 440 and media receiver interface 402 are part of media receiver 400. Similarly, in one embodiment, receiver 440, media player interface 413, and media player 414 are all part of the same device. In an alternative embodiment, receiver 440, media player interface 413, media player 414, and display 415 are all part of the display. An example of such a device is shown in FIG. 6.

In one embodiment, transmitter device 440 comprises a processor 403, an optional baseband processing component 404, a phased array antenna 405, and a wireless communication channel interface 406. Phased array antenna 405 comprises a radio frequency (RF) transmitter having a digitally controlled phased array antenna coupled to and controlled by processor 403 to transmit content to receiver device 441 using adaptive beam forming.

In one embodiment, receiver device 441 comprises a processor 412, an optional baseband processing component 411, a phased array antenna 410, and a wireless communication channel interface 409. Phased array antenna 410 comprises a radio frequency (RF) transmitter having a digitally controlled phased array antenna coupled to and controlled by processor 412 to receive content from transmitter device 440 using adaptive beam forming.

In one embodiment, processor 403 generates baseband signals that are processed by baseband signal processing 404 prior to being wirelessly transmitted by phased array antenna 405. In such a case, receiver device 441 includes baseband signal processing to convert analog signals received by phased array antenna 410 into baseband signals for processing by processor 412. In one embodiment, the baseband signals are orthogonal frequency division multiplex (OFDM) signals.

In one embodiment, transmitter device 440 and/or receiver device 441 are part of separate transceivers.

Transmitter device 440 and receiver device 441 perform wireless communication using phased array antenna with adaptive beam forming that allows beam steering. Beam forming is well known in the art. In one embodiment, processor 403 sends digital control information to phased array antenna 405 to indicate an amount to shift one or more phase shifters in phased array antenna 405 to steer a beam formed thereby in a manner well-known in the art. Processor 412 uses digital control information as well to control phased array antenna 410. The digital control information is sent using control channel 421 in transmitter device 440 and control channel 422 in receiver device 441. In one embodiment, the digital control information comprises a set of coefficients. In one embodiment, each of processors 403 and 412 comprises a digital signal processor.

Wireless communication link interface 406 is coupled to processor 403 and provides an interface between wireless communication link 407 and processor 403 to communicate antenna information relating to the use of the phased array antenna and to communicate information to facilitate playing the content at another location. In one embodiment, the information transferred between transmitter device 440 and receiver device 441 to facilitate playing the content includes encryption keys sent from processor 403 to processor 412 of receiver device 441 and one or more acknowledgments from processor 412 of receiver device 441 to processor 403 of transmitter device 440.

Wireless communication link 407 also transfers antenna information between transmitter device 440 and receiver device 441. During initialization of the phased array antennas 405 and 410, wireless communication link 407 transfers information to enable processor 403 to select a direction for the phased array antenna 405. In one embodiment, the information includes, but is not limited to, antenna location information and performance information corresponding to the antenna location, such as one or more pairs of data that include the position of phased array antenna 410 and the signal strength of the channel for that antenna position. In another embodiment, the information includes, but is not limited to, information sent by processor 412 to processor 403 to enable processor 403 to determine which portions of phased array antenna 405 to use to transfer content.

When the phased array antennas 405 and 410 are operating in a mode during which they may transfer content (e.g., HDMI content), wireless communication link 407 transfers an indication of the status of communication path from the processor 412 of receiver device 441. The indication of the status of communication comprises an indication from processor 412 that prompts processor 403 to steer the beam in another direction (e.g., to another channel). Such prompting may occur in response to interference with transmission of portions of the content. The information may specify one or more alternative channels that processor 403 may use.

In one embodiment, the antenna information comprises information sent by processor 412 to specify a location to which receiver device 441 is to direct phased array antenna 410. This may be useful during initialization when transmitter device 440 is telling receiver device 441 where to position its antenna so that signal quality measurements can be made to identify the best channels. The position specified may be an exact location or may be a relative location such as, for example, the next location in a predetermined location order being followed by transmitter device 440 and receiver device 441.

In one embodiment, wireless communications link 407 transfers information from receiver device 441 to transmitter device 440 specifying antenna characteristics of phased array antenna 410, or vice versa.

An Example of a Transceiver Architecture

Figure 5:
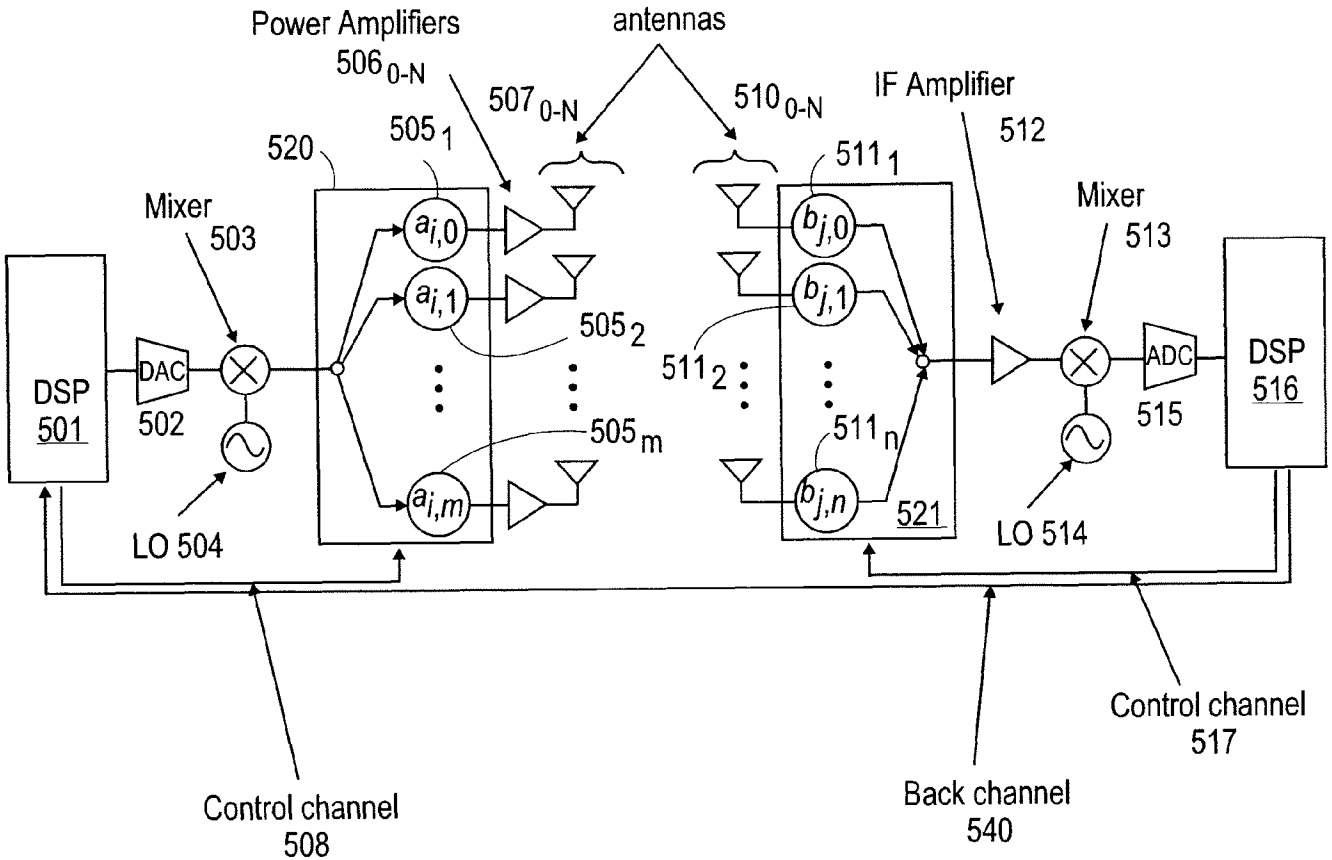
FIG. 5 is a more detailed block diagram of one embodiment of the communication system.

FIG. 5 is a block diagram of one embodiment of an adaptive beam forming multiple antenna radio system containing transmitter device 440 and receiver device 441 of FIG. 4. Transceiver 500 includes multiple independent transmit and receive chains. Transceiver 500 performs phased array beam forming using a phased array that takes an identical RF signal and shifts the phase for one or more antenna elements in the array to achieve beam steering.

Referring to FIG. 5, Digital Signal Processor (DSP) 501 formats the content and generates real time baseband signals. DSP 501 may provide modulation, FEC coding, packet assembly, interleaving and automatic gain control.

DSP 501 then forwards the baseband signals to be modulated and sent out on the RF portion of the transmitter. In one embodiment, the content is modulated into OFDM signals in a manner well known in the art.

Digital-to-analog converter (DAC) 502 receives the digital signals output from DSP 501 and converts them to analog signals. In one embodiment, the signals output from DAC 502 are between 0-256 MHz signals.

Mixer 503 receives signals output from DAC 502 and combines them with a signal from a local oscillator (LO) 504. The signals output from mixer 503 are at an intermediate frequency. In one embodiment, the intermediate frequency is between 2-9 GHz.

Multiple phase shifters $\mathbf{505}_{0\text{-}N}$ receive the output from mixer 503. A demultiplier is included to control which phase shifters receive the signals. In one embodiment, these phase shifters are quantized phase shifters. In an alternative embodiment, the phase shifters may be replaced by complex multipliers. In one embodiment, DSP 501 also controls, via control channel 508, the phase and magnitude of the currents in each of the antenna elements in phased array antenna 520 to produce a desired beam pattern in a manner well-known in the art. In other words, DSP 501 controls the phase shifters $\mathbf{505}_{0\text{-}N}$ of phased array antenna 520 to produce the desired pattern.

Each of phase shifters $\mathbf{505}_{0\text{-}N}$ produce an output that is sent to one of power amplifiers $\mathbf{506}_{0\text{-}N}$, which amplify the signal. The amplified signals are sent to antenna array 507 which has multiple antenna elements $\mathbf{507}_{0\text{-}N}$. In one embodiment, the signals transmitted from antennas $\mathbf{507}_{0\text{-}N}$ are radio frequency signals between 56-64 GHz. Thus, multiple beams are output from phased array antenna 520.

With respect to the receiver, antennas $\mathbf{510}_{0\text{-}N}$ receive the wireless transmissions from antennas $\mathbf{507}_{0\text{-}N}$ and provide them to phase shifters $\mathbf{511}_{0\text{-}N}$. As discussed above, in one embodiment, phase shifters $\mathbf{511}_{0\text{-}N}$ comprise quantitized phase shifters. Alternatively, phase shifters $\mathbf{511}_{0\text{-}N}$ may be replaced by complex multipliers. Phase shifters $\mathbf{511}_{0\text{-}N}$ receive the signals from antennas $\mathbf{510}_{0\text{-}N}$, which are combined to form a single line feed output. In one embodiment, a multiplexer is used to combine the signals from the different elements and output the single feed line. The output of phase shifters $\mathbf{511}_{0\text{-}N}$ is input to intermediate frequency (IF) amplifier 512, which reduces the frequency of the signal to an intermediate frequency. In one embodiment, the intermediate frequency is between 2-9 GHz.

Mixer 513 receives the output of the IF amplifier 512 and combines it with a signal from LO 514 in a manner well-known in the art. In one embodiment, the output of mixer 513 is a signal in the range of 0-250 MHz. In one embodiment, there are I and Q signals for each channel.

Analog-to-digital converter (ADC) 515 receives the output of mixer 513 and converts it to digital form. The digital output from ADC 515 is received by DSP 516. DSP 516 restores the amplitude and phase of the signal. DSPs 516 may provide demodulation, packet disassembly, de-interleaving and automatic gain control.

In one embodiment, each of the transceivers includes a controlling microprocessor that sets up control information for DSP. The controlling microprocessor may be on the same die as the DSP.

DSP-Controlled Adaptive Beam Forming

In one embodiment, the DSPs implement an adaptive algorithm with the beam forming weights being implemented in hardware. That is, the transmitter and receiver work together to perform the beam forming in RF frequency using digitally controlled analog phase shifters; however, in an alternative embodiment, the beam forming is performed in IF. Phase shifters $\mathbf{505}_{0\text{-}N}$ and $\mathbf{511}_{0\text{-}N}$ are controlled via control channel 508 and control channel 517, respectfully, via their respective DSPs in a manner well known in the art. For example, DSP 501 controls phase shifters $\mathbf{505}_{0\text{-}m}$ to have the transmitter perform adaptive beam forming to steer the beam while DSP 511 controls phase shifters $\mathbf{511}_{0\text{-}N}$ to direct antenna elements to receive the wireless transmission from antenna elements and combine the signals from different elements to form a single line feed output. In one embodiment, a multiplexer is used to combine the signals from the different elements and output the single feed line.

DSP 501 performs the beam steering by pulsing, or energizing, the appropriate phase shifter connected to each antenna element. The pulsing algorithm under DSP 501 controls the phase and gain of each element. Performing DSP controlled phase array beamforming is well known in the art.

The adaptive beam forming antenna is used to avoid interfering obstructions. By adapting the beam forming and steering the beam, the communication can occur avoiding obstructions which may prevent or interfere with the wireless transmissions between the transmitter and the receiver.

In one embodiment, with respect to the adaptive beamforming antennas, they have three phases of operations. The three phases of operations are the training phase, a searching phase, and a tracking phase. The training phase and searching phase occur during initialization. The training phase determines the channel profile with predetermined sequences of spatial patterns $\{A_i\}$ and $\{B_j\}$. The searching phase computes a list of candidate spatial patterns $\{A_i\}$, $\{B_j\}$ and selects a prime candidate $\{A_{\hat{0}}, B_{\hat{0}}\}$ for use in the data transmission between the transmitter of one transceiver and the receiver of another. The tracking phase keeps track of the strength of the candidate list. When the prime candidate is obstructed, the next pair of spatial patterns is selected for use.

In one embodiment, during the training phase, the transmitter sends out a sequence of spatial patterns $\{A_i\}$. For each spatial pattern $\{A_i\}$, the receiver projects the received signal onto another sequence of patterns $\{B_j\}$. As a result of the projection, a channel profile is obtained over the pair $\{A_i\}$, $\{B_j\}$.

In one embodiment, an exhaustive training is performed between the transmitter and the receiver in which the antenna of the receiver is positioned at all locations and the transmitter sending multiple spatial patterns. Exhaustive training is well-known in the art. In this case, M transmit spatial patterns are transmitted by the transmitter and N received spatial patterns are received by the receiver to form an N by M channel matrix. Thus, the transmitter goes through a pattern of transmit sectors and the receiver searches to find the strongest signal for that transmission. Then the transmitter moves to the next sector. At the end of the exhaustive search process, a ranking of all the positions of the transmitter and the receiver and the signals strengths of the channel at those positions has been obtained. The information is maintained as pairs of positions of where the antennas are pointed and signal strengths of the channels. The list may be used to steer the antenna beam in case of interference.

In an alternative embodiment, bi-section training is used in which the space is divided in successively narrow sections with orthogonal antenna patterns being sent to obtain a channel profile.

Assuming DSP 501 is in a stable state and the direction the antenna should point is already determined. In the nominal state, the DSP will have a set of coefficients that it sends the phase shifters. The coefficients indicate the amount of phase the phase shifter is to shift the signal for its corresponding antennas. For example, DSP 501 sends a set digital control information to the phase shifters that indicate the different phase shifters are to shift different amounts, e.g., shift 30 degrees, shift 45 degrees, shift 90 degrees, shift 180 degrees, etc. Thus, the signal that goes to that antenna element will be shifted by a certain number of degrees of phase. The end result of shifting, for example, 16, 34, 32, 64 elements in the array by different amounts enables the antenna to be steered in a direction that provides the most sensitive reception location for the receiving antenna. That is, the composite set of shifts over the entire antenna array provides the ability to stir where the most sensitive point of the antenna is pointing over the hemisphere.

Note that in one embodiment the appropriate connection between the transmitter and the receiver may not be a direct path from the transmitter to the receiver. For example, the most appropriate path may be to bounce off the ceiling.

The Back Channel

In one embodiment, the wireless communication system includes a back channel 540, or link, for transmitting information between wireless communication devices (e.g., a transmitter and receiver, a pair of transceivers, etc.). The information is related to the beam forming antennas and enables one or both of the wireless communication devices to adapt the array of antenna elements to better direct the antenna elements of a transmitter to the antenna elements of the receiving device together. The information also includes information to facilitate the use of the content being wirelessly transferred between the antenna elements of the transmitter and the receiver.

In FIG. 5, back channel 540 is coupled between DSP 516 and DSP 501 to enable DSP 516 to send tracking and control information to DSP 501. In one embodiment, back channel 540 functions as a high speed downlink and an acknowledgement channel.

In one embodiment, the back channel is also used to transfer information corresponding to the application for which the wireless communication is occurring (e.g., wireless video). Such information includes content protection information. For example, in one embodiment, the back channel is used to transfer encryption information (e.g., encryption keys and acknowledgements of encryption keys) when the transceivers are transferring HDMI data. In such a case, the back channel is used for content protection communications.

More specifically, in HDMI, encryption is used to validate that the data sink is a permitted device (e.g., a permitted display). There is a continuous stream of new encryption keys that is transferred while transferring the HDMI data stream to validate that the permitted device hasn't changed. Blocks of frames for the HD TV data are encrypted with different keys and then those keys have to be acknowledged back on back channel 540 in order to validate the player. Back channel 540 transfers the encryption keys in the forward direction to the receiver and acknowledgements of key receipts from the receiver in the return direction. Thus, encrypted information is sent in both directions.

The use of the back channel for content protection communications is beneficial because it avoids having to complete a lengthy retraining process when such communications are sent along with content. For example, if a key from a transmitter is sent alongside the content flowing across the primary link and that primary link breaks, it will force a lengthy retrain of 2-3 seconds for a typical HDMI/HDCP system. In one embodiment, this separate bi-directional link that has higher reliability than the primary directional link given it's omni-directional orientation. By using this back channel for communication of the HDCP keys and the appropriate acknowledgement back from the receiving device, the time consuming retraining can be avoided even in the event of the most impactful obstruction.

During the active period when the beamforming antennas are transferring content, the back channel is used to allow the receiver to notify the transmitter about the status of the channel. For example, while the channel between the beamforming antennas is of sufficient quality, the receiver sends information over the back channel to indicate that the channel is acceptable. The back channel may also be used by the receiver to send the transmitter quantifiable information indicating the quality of the channel being used. If some form of interference (e.g., an obstruction) occurs that degrades the quality of the channel below an acceptable level or prevents transmissions completely between the beamforming antennas, the receiver can indicate that the channel is no longer acceptable and/or can request a change in the channel over the back channel. The receiver may request a change to the next channel in a predetermined set of channels or may specify a specific channel for the transmitter to use.

In one embodiment, the back channel is bi-directional. In such a case, in one embodiment, the transmitter uses the back channel to send information to the receiver. Such information may include information that instructs the receiver to position its antenna elements at different fixed locations that the transmitter would scan during initialization. The transmitter may specify this by specifically designating the location or by indicating that the receiver should proceed to the next location designated in a predetermined order or list through which both the transmitter and receiver are proceeding.

In one embodiment, the back channel is used by either or both of the transmitter and the receiver to notify the other of specific antenna characterization information. For example, the antenna characterization information may specify that the antenna is capable of a resolution down to 6 degrees of radius and that the antenna has a certain number of elements (e.g., 32 elements, 64 elements, etc.).

In one embodiment, communication on the back channel is performed wirelessly by using interface units. Any form of wireless communication may be used. In one embodiment, OFDM is used to transfer information over the back channel. In another embodiment, CPM is used to transfer information over the back channel.

While the invention has been described in conjunction with specific embodiments thereof, many alternatives, modifications and variations will be apparent to those of ordinary skill in the art in light of the foregoing description. For example, any balanced feeding structure could replace the combination of microstrip line and the balun without departing the scope of the present invention. Accordingly, the invention is intended to embrace all such alternatives, modifications and variations as fall within the broad scope of the appended claims.

We claim:

1. A planar antenna comprising:
a driver having a folded dipole;
coplanar strips coupled with the driver;
an integral balun coupled with the coplanar strips;
a substrate, with a first side and a second side opposite to the first side, having a dielectric constant of at least 10, the first side coupled with the driver, the coplanar strips, and the integral balun;
a truncated ground plane coupled with the second side of the substrate, the truncated ground plane having a continuous serrated edge for reflecting waves; and
a feeding structure having a coplanar waveguide (CPW), on the first side of the substrate, coupled with the integral balun to feed the integral balun.

2. The planar antenna defined in claim 1 further comprising a differential input structure on the first side of the substrate, the differential input structure coupled with the integral balun and the coplanar strips.

3. The planar antenna defined in claim 1 further comprising: one or more directors, wherein the one or more directors and the driver are on the first side of the substrate.

4. The planar antenna defined in claim 1, wherein the folded dipole and the integral balun are on the first side of the substrate.

5. The planar antenna defined in claim 1, wherein the feeding structure is a balanced feeding structure.

6. The planar antenna in claim 1, wherein the integral balun comprises a microstrip line.

7. The planar antenna in claim 2, wherein the differential input structure comprises a microstrip line.

8. The planar antenna in claim 1, wherein the truncated ground resides between the driver and the feeding structure.

9. A planar antenna comprising:
a driver having a folded dipole;
an integral balun coupled with the driver;
a substrate with a first side and a second side opposite to the first side, the first side coupled with the driver and the integral balun;
a truncated ground plane coupled with the second side of the substrate and having a continuous serrated edge for reflecting waves; and
a feeding structure on the first side of the substrate coupled with the integral balun to feed the integral balun.

10. The planar antenna defined in claim 9 further comprising a differential input structure on the first side of the substrate, the differential input structure coupled with the integral balun and coplanar strips, wherein the coplanar strips are coupled with the driver.

11. The planar antenna in claim 10, wherein the differential input structure comprises a microstrip line.

12. The planar antenna defined in claim 9 further comprising:
one or more directors, wherein the one or more directors and the driver are on the first side of the substrate.

13. The planar antenna defined in claim 9, wherein the folded dipole and the integral balun are on the first side of the substrate.

14. The planar antenna defined in claim 9, wherein the feeding structure is a balanced feeding structure.

15. The planar antenna in claim 9, wherein the integral balun comprises a microstrip line.

16. The planar antenna in claim 9, wherein the truncated ground resides between the driver and the feeding structure.

17. The planar antenna in claim 9, wherein the truncated ground has a straight edge.

18. The planar antenna in claim 9, wherein the substrate has a dielectric constant which is at least 10.

* * * * *